US006957533B1

(12) United States Patent
Olsson

(10) Patent No.: US 6,957,533 B1
(45) Date of Patent: Oct. 25, 2005

(54) OPERATION DEVICE

(75) Inventor: Olle Olsson, Landskrona (SE)

(73) Assignee: Besam International HB, Landskrona (SE)

( * ) Notice: Subject to any disclaimer, the term of this patent is extended or adjusted under 35 U.S.C. 154(b) by 0 days.

(21) Appl. No.: 10/031,863

(22) PCT Filed: May 3, 2000

(86) PCT No.: PCT/SE00/00836

§ 371 (c)(1),
(2), (4) Date: May 6, 2002

(87) PCT Pub. No.: WO00/66864

PCT Pub. Date: Nov. 9, 2000

(30) Foreign Application Priority Data

May 4, 1999 (SE) ..... 9901600

(51) Int. Cl.[7] ..... F15B 7/00
(52) U.S. Cl. ..... 60/545; 92/130 R
(58) Field of Search ..... 60/545, 477, 533; 92/136, 130 R

(56) References Cited

U.S. PATENT DOCUMENTS 2,324,635 A * 7/1943 Meyer ..... 60/481
2,739,808 A * 3/1956 Carlson ..... 92/130 R
3,815,361 A * 6/1974 Manini ..... 60/477
4,333,270 A 6/1982 Catlett
4,660,250 A 4/1987 Tillman et al.
5,046,402 A 9/1991 Lagace
5,513,467 A 5/1996 Current et al.
5,651,162 A 7/1997 Keszthelyi
5,655,371 A 8/1997 Chuang et al.
6,220,029 B1 * 4/2001 Huber ..... 60/477

FOREIGN PATENT DOCUMENTS

EP 0 166 285 A2 1/1984
GB 1 406 126 9/1975

* cited by examiner

*Primary Examiner*—Edward K. Look
*Assistant Examiner*—Igor Kershteyn
(74) *Attorney, Agent, or Firm*—Brinks Hofer Gilson & Lione

(57) ABSTRACT

The invention relates to a device for opening of doors. Electromechanical systems contain many expensive components and are thereby expensive to manufacture. Installed electromechanical systems are expensive in operation by virtue of the high and energy-demanding friction which always are present in mechanical constructions. The present operating device is less energy-demanding by the formed transmission of power via two piston-like parts (5 and 6). A driving device (2) is arranged to drive the piston-like part (5) and the second piston-like part (6) is connected to an operable element.

15 Claims, 2 Drawing Sheets

OPERATION DEVICE

This application is a nationalization of and priority under PCT Application No. PCT/SE00/00836 that was filed on May 3, 2000. This application was published, in accordance with PCT Article 21(2), in the English language as WO 00/66864 on Nov. 9, 2000. PCT Application No. PCT/SE00/00836 claimed priority under Swedish Patent Application No. 9901600-8 that was filed on May 4, 1999.

TECHNICAL FIELD OF THE INVENTION

The present invention relates to a device for the operating of preferably doors, gates and such operable elements according to the type described in the introduction of claim 1.

BACKGROUND OF THE INVENTION

At operating devices for doors, gates and such elements, it is common to use electrohydraulic systems. If the operating device is to manage pivot operation, it is more common with an electromechanic system. Irrespective of the choice of system, problems arise when a operating device is to be mounted at an already existing operable element. The space available at, e.g., a door is a limiting factor. This may cause expensive alteration costs in order to modify the space. At production of new houses, the cost also increases when operating devices occupy space.

With the classification operating device for elements is referred to devices that cause doors, gates and such to move either linearly or to pivot. The devices permit left hung or right hung elements, outer elements or inner elements and the devices may be placed on optional side of the element.

The patent specification GB 1 406 126 shows an electrohydraulic door opener and the object of the invention is to make a space-saving and handy device. The door opener comprises a combination of a hydraulic motor, a hydraulic fluid tank, a motor driven hydraulic pump and hydraulic lines, which together form a closed hydraulic circuit/loop. A rotating motor drives or operates the pump. In order to save space, a spring housing 14 is also utilized as a hydraulic fluid tank.

The patent specification U.S. Pat. No. 4,333,270 shows an electromechanic door opener. The object of the invention is to make a door opener, which is cheap to manufacture and which fits for different types of pivoting doors. Furthermore, the object is to make a door opener that, among other thing, has a long service life. The solution is based on a construction that, among other things, contains a rack and a gearwheel. It does not contain any hydraulics.

Problems arise when the operating device should be inexpensive to manufacture and to operate and quiet. The electrohydraulic systems contain numerous and expensive components and are thereby expensive to manufacture. Installed electrohydraulic systems are energy-demanding and thereby expensive to operate. Also electromechanical systems contain many expensive components and are thereby also expensive to manufacture. Installed electromechanical systems are expensive to operate because of the high energy-demanding friction always inherent in mechanical constructions. Hydraulic pumps as well as mechanical transmissions generate noise that in the long run may be perceived as disturbing.

On production of operating devices of the above-mentioned type, the need thereby arises to manufacture devices consisting of a few inexpensive components and which devices, ready-made and mounted, are silent and inexpensive to operate. The operating device should be a small, compact constructional solution, which does not demand any large mounting space.

None of the operating devices, which are shown in the stated patent specifications, can meet this need.

SUMMARY OF THE INVENTION

On designing operating devices for moveable elements, according to the invention, the designing is to be such that the device includes a few inexpensive components only and that the completed device is not energy-demanding on operation. Furthermore, the object of the invention is that the device is to be a small, compact and easy-to-mount device working at a very low sound level.

The operating device according to the invention should be able to be used generally, regardless if the element should be manoeuvred by linear or rotary motion. It is to withstand an exposure to overload and allow also manual operation. In certain environments, it is furthermore necessary that the device has self-closing function.

The trend of operating devices for elements of the present kind is towards more flexible systems, with the device being a standard component. The customer may then decide where and how the device shall be mounted and operate.

In the light of the above-mentioned needs, a operating device should be designed so that it is simple to install and fits for mounting and operation at hinges, butt hinges or at a distance from the hinges, at either end of the element to be operated.

The object of the present invention is thereby to bring about a operating device which fits for most applications, is silent and demands neither large space nor high energy. It should work, for instance, on evacuation situations by permitting opening/closing at power failure.

The solution according to the invention is a operating device, which includes a driving device, arranged adjacent to a closed casing or house. The house is connected to at least one operable element. The transmission of power from the driving device to the operable element to be operated goes via the closed house. The driving device is connected to and drives a first piston means, which is displaceably arranged inside the house. A second piston device is displaceably arranged inside the house at a distance from the first piston device. Inside the closed house, a space is provided by the opposing pressure areas of the first and second piston-like parts and the inner wall of the house. This space is filled with a pressure force-transmitting fluid, which gives a simple, cheap, disengageable and noiseless force transmission. Since the construction works with low friction, the driving device may be a relatively weak motor, i.e. a proportionately small motor. The entire operating device may be housed in a tubular part.

BRIEF DESCRIPTION OF THE DRAWINGS

The invention will be explained closer by description of an embodiment example with reference to the accompanying drawing, where.

DETAILED DESCRIPTION OF PREFERRED EMBODIMENT

Figure 1:
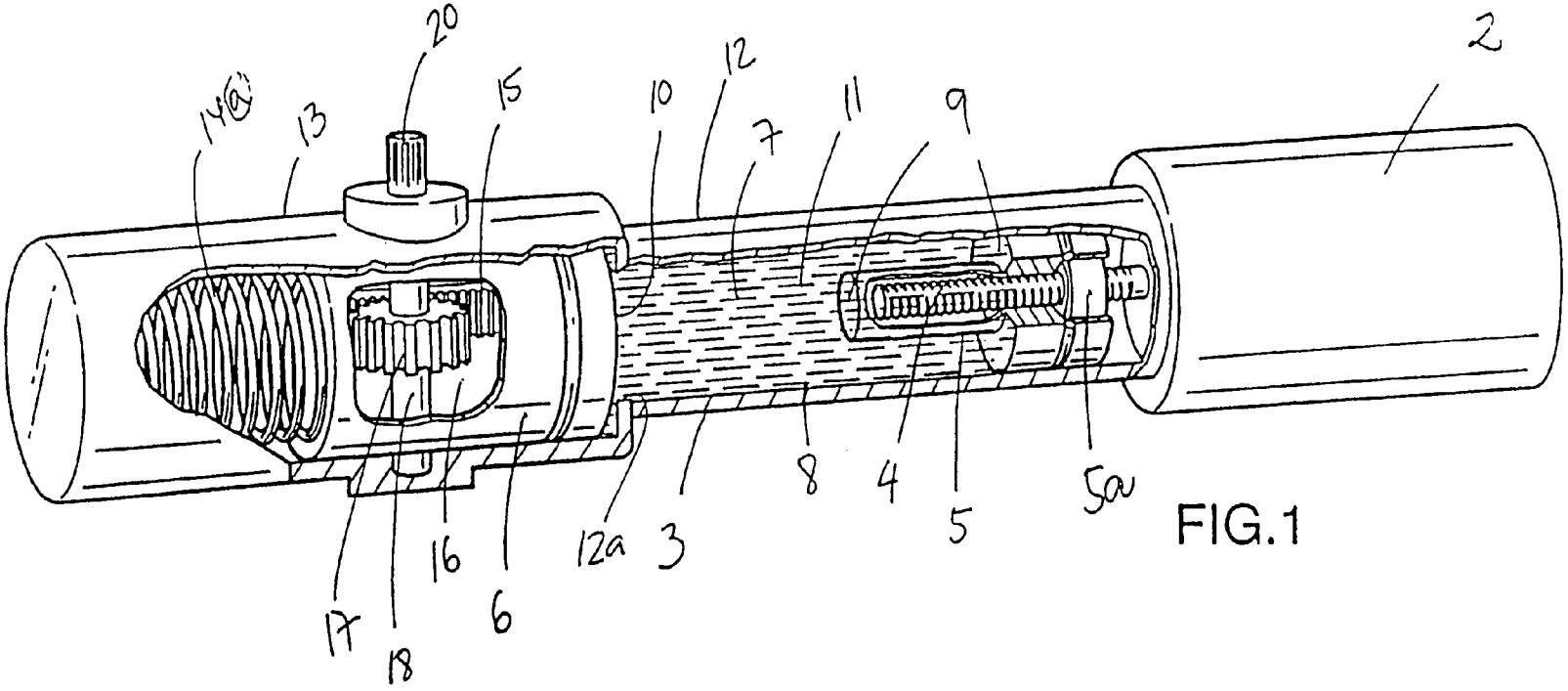
FIG. 1 shows a operating device for the operating of an element according to the invention.
Figure 2:
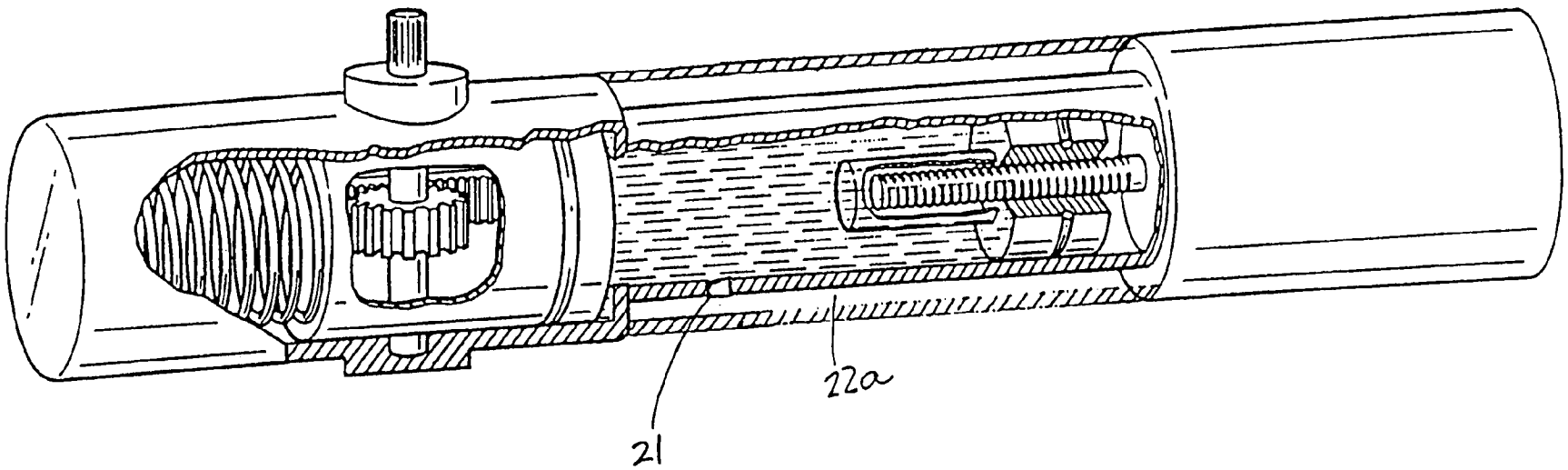
FIG. 2 shows an alternative embodiment where the operating device is arranged with an electrically controlled valve.

The invention relates to a operating device 1 (FIG. 1) which comprises a driving device 2 in the form of a speed controlled, alternatively non-speed controlled, suitably reversible electric motor arranged directly adjacent to a closed case or house 3. The drive shaft of the electric motor includes a screw and nut device 4-5, for instance a self-locking ball screw, which sealingly extends into the closed house 3. Thereby, a relatively small electric motor may be selected. Inside the closed house 3, the drive shaft/ball roller screw 4 co-operates with a first piston-like part/nut device 5, which is displaceably arranged inside the house 3. A second piston-like part 6 is displaceably arranged inside the house 3 against the action of a spring 14 at a distance from, and suitably coaxially with, the first piston-like pad 5. Thereby, a closed volume 7 is provided, which is limited by the inner wall 8 of the house 3 and the opposing end areas 9 and 10 of the first 5 and second 6 piston-like parts, respectively. The volume 7 is filled with a pressure-transmitting medium 11. In FIG. 1, the closed house 3 consists of two cylindric portions 12, 13 having different diameters. The portion 12 with the smaller diameter may be regarded as one pump cylinder and the first piston-like part 5 is then a pump piston. The incompressible fluid 11 works as a pump fluid. The portion 13 of the house 3 with the larger diameter may thereby be regarded as a slave cylinder or actuator containing the second displaceable piston-like part 6, which is arranged prestressed by a spring. The space between the slave cylinder and the pump cylinder is provided by the opening 14 between the cylinders.

The electric motor 2 is arranged to drive the first piston-like part 5 in two opposite directions. When the electric motor 2 drives the pump piston 5 forwards, in the left direction in FIG. 1, the pump piston 5 presses against the incompressible fluid 11 and transmits a compressive force which acts on the second piston-like part 6. The compressive force from the incompressible fluid 11 acts on the second piston-like part 6 in the direction towards the spring-prestressing force from a spring device 14. When the driving device 2 via the incompressible fluid 11 has generated a compressive force, on the second piston-like part 6, which exceeds the back-pressure power from the screw spring 14*a*, a displacement of the second piston-like part is carried out in the left direction in FIG. 1.

The second piston-like part 6 consists of a hollow piston slotted from one end (not shown) with a rack 15 fixedly arranged on the inside 16 of the piston. The rack 15 is parallel to the direction of motion of the piston 6 and the teeth are formed in a direction, at an angle with the longitudinal direction, preferably a right angle to the longitudinal direction. The rack 15 co-operates with a gear-wheel 17, which is arranged on a shaft 18 rotatably mounted in the house 3 and extending through the slotted piston 6. The shaft 18 is arranged perpendicularly to the direction of motion of the piston 6 transverse through the piston and is thus rotatably received in the surrounding cylinder wall, i.e. the wall of the closed house 3. The opposite end 20 of the shaft passes through a sealed bearing hole in the surrounding cylinder, i.e. the wall of the closed house, and forms exterior drive shaft 20, with, for instance, splines. The outer drive shaft 20 is connected to a transmission, for instance an arm, which transmits a linear or rotary motion to an element (not shown) to be operated.

The screw 4 runs in the cylinder 5, e.g. in a recess or a bottom hole, and a driving nut 5*a* is mounted in the piston end adjacent the motor. The extension along the screw 4 of the driving nut 5*a* is small in comparison with the piston 5. By the fact that the contact surface between the screw 4 and the piston 5 thereby becomes relatively small, the friction will be low.

On displacing the second piston-like part 6 in the direction to the left in FIG. 1, the rack 15 is displaced in the same direction, and thereby both the gear wheel 17 and the outer drive shaft end 20 are rotated anti-clockwise in FIG. 1.

When the electric motor 2 moves the pump piston 5 back, in the direction to the right in FIG. 1, the pressure of the incompressible fluid 11 on the second piston-like part 6 decreases. When the pressure goes below the preset force of the spring, the spring 14*a* acts on the piston 6 and moves it in the direction to the right in FIG. 1.

On displacing the second piston-like part 6 the right in FIG. 1, the rack 15 is displaced in the same direction, and thereby both the gear wheel 17 and the outer drive shaft/driving nut 20 are rotated clockwise in FIG. 1.

The outer end 20 of the drive shaft may thereby transmit rotary motions so that an element (not shown) is moved either to the right or to the left, or rotates clockwise or anticlockwise, respectively. The transmission ratio may be chosen suitable for the application thereof. Also the requisite pressure may be changed/chosen after application.

It is also simple to adjust the length of stroke for an operable element at both for normal and emergency opening operations.

ALTERNATIVE DESIGNS

The driving device is an electric motor in the embodiment example, but it may also be another, preferably rotating, driving means.

The first and the second piston-like part may be arranged with parallel shafts and may also be arranged so that the shafts form an angle with each other. The piston-like parts can also be arranged in parallel to each other, side by side. In such cases, the house or space becomes a straight/angled/curved room.

The space beyond the slave cylinder, counted from the driving device in the shown embodiment example, is empty but may also contain oil.

The screw-nut device may be of non-self-braking type and the force of the spring used for closing the door. This means that the device is self-closing at power failure.

In the shown embodiment example, the manoeuvring is carried out with a speed controlled driving device, but it is also possible to adjust the speed of the element by means of conventional control or check valves.

The first piston device may be formed as a bellows.

The operating device may be arranged to simultaneously bias or operate a plurality of elements, for instance wing doors. It may also be arranged with more than one closed house in order to drive a plurality of elements at the same time.

A safety valve may be arranged so that on onverloading the fluid can flow out into an adjacent space. An alternative is to built-in weak sections at the device, adapted to on overload.

In order to make it possible to return an element to the start position on power failure, an electric current-controlled valve 21 may be arranged in the wall of the house. At power failure, the valve opens and fluid may thereby flow out in an adjacent space 22, the compressive force/back pressure from the incompressible fluid 11 on the second piston-like part 6 decreasing/ceasing, and thereby the spring-prestressing force of the spring 14*a* may push the piston 6 in the direction to the right in the figure, a connected element returning to the starting position, e.g. a door is closed. In doing so, the device has to be dimensioned in such a way that the first piston-like part never mechanically blocks the second piston-like part from being displaced back to the starting position.

In order for the device to be able to be operated manually at power failure, an electric current-controlled valve 21 may be arranged in the wall of the house. At power failure, the valve opens, if required, and fluid may thereby flow in from an adjacent space (not shown). A connected element is transported manually, the second piston-like part being displaced in the direction to the right in the figure. The manual operating requires a force exceeding the set force of the spring 14*a* Furthermore, fluid has to flow into the house 3 from an adjacent room/reservoir (not shown) at the displacement of the second piston-like part 6.

It is important that the electric current-controlled valve never is obstructed by any of the piston devices. Therefore, it is placed in the house wall, between the piston-like parts, but outside the range of movement of these parts along the inner wall 8.

The adjacent room 22 to which fluid flows or from which fluid flows may be arranged in various ways. It may, e.g., be an open vessel, a pressure accumulator or it may contain a piston prestressed by a spring. The room 22*a* may be provided by arranging the closed house with double walls, where the valve is arranged in the inner wall. The room may be filled with a suitable quantity of gas.

An operating device self-closing at power failure requires that the room, irrespective of the design, has a volume that at least equals the displacing volume of the second piston-like part.

An operating device manually openable at power failure requires that the room, irrespective of design, has at least a volume that equals the double displacing volume of the second piston-like part.

What is claimed is:

1. Operation device for closures comprising:

a driving device;

a closed house;

a first piston-like part and a second piston-like part, wherein the first and second piston-like parts are displaceable inside the house and are arranged at a distance from each other inside the house, and where the driving device is arranged to displace the first piston-like part inside the house and the second piston-like part being connected to an operable element;

an electric current-controlled valve is arranged in a wall of the house; and wherein a volume formed in the closed house, between the first and the second piston-like parts, is filled with a compressive force transmitting medium.

2. Operating device according to claim 1, wherein the electric current-controlled valve is located in the wall of the house, between the first and second piston-like parts but outside the range and movement of the first and second piston-like parts along the wall.

3. Operating device according to claim 1, wherein the first and second piston-like parts are coaxially arranged in relation to each other.

4. Operating device according to claim 1, wherein the force transmitting medium consists essentially of a substantially incompressible fluid.

5. Operating device according to claim 1, wherein the second piston-like part is displaceable against the effect of a spring device arranged in the house.

6. Operating device according to claim 5, wherein the spring device is a screw spring.

7. Operating device according to claim 1, wherein the driving device is an electric motor comprising a drive shaft that is drivingly connected to the first piston-like part.

8. Operating device according to claim 1, wherein the driving device is arranged to drive the first piston-like part in two opposite directions.

9. Operating device according to claim 1, wherein the second piston-like part is connected to the movable closure, which is to be operated, via a transmission.

10. Operating device according to claim 9, wherein the transmission gives the movable closure a linear motion.

11. Operating device according to claim 9, wherein the transmission gives the movable closure a rotary motion.

12. Operating device according to claim 1, wherein the movable closure is a door.

13. Operating device according to claim 1, wherein the operable device is connected to a movable closure that moves in response to movement of the second piston-like part.

14. Operating device according to claim 13, wherein the movable closure is a door.

15. Operating device according to claim 1, wherein the operable device comprises:

a rack connected to the second piston-like part; and a gear wheel that rotatably engages the rack.

* * * * *